US011255031B1

(12) United States Patent
Chapman

(10) Patent No.: US 11,255,031 B1
(45) Date of Patent: Feb. 22, 2022

(54) CROCHET JIG

(71) Applicant: Kim Y. Chapman, San Antonio, TX (US)

(72) Inventor: Kim Y. Chapman, San Antonio, TX (US)

( * ) Notice: Subject to any disclaimer, the term of this patent is extended or adjusted under 35 U.S.C. 154(b) by 62 days.

(21) Appl. No.: 16/716,599

(22) Filed: Dec. 17, 2019

(51) Int. Cl.
*D04B 3/00* (2006.01)

(52) U.S. Cl.
CPC ..... *D04B 3/00* (2013.01)

(58) Field of Classification Search
CPC .. D04B 3/00; D04B 3/06; D04B 33/00; A47B 2200/0036; A47B 2200/0044; A47B 2003/0806; A47B 19/06; A47B 27/02; A47B 47/0058
USPC ..... 66/1 A; 112/217.1; 242/139
See application file for complete search history.

(56) References Cited

U.S. PATENT DOCUMENTS 248,669 A * 10/1881 Sackett ..... D04B 33/00 28/149
254,258 A * 2/1882 Barbour ..... D04B 33/00 28/149
254,288 A * 2/1882 Dimmick ..... D04B 33/00 28/149
769,492 A * 9/1904 Sanders ..... D04D 11/00 28/150
1,418,967 A * 6/1922 Petermann ..... D04B 3/00 66/4
1,533,451 A * 4/1925 Overcash ..... D04B 3/00 242/129.51
1,632,302 A * 6/1927 Lichtenstein ..... G09B 19/20 434/95
1,829,288 A * 10/1931 May ..... A47B 27/02 108/4
2,162,294 A 6/1939 Baldwin
2,264,664 A * 12/1941 Geisman ..... D04B 3/06 242/137.1
2,628,064 A * 2/1953 Goddard ..... F01D 5/081 416/90 R
2,795,031 A * 6/1957 Gierling ..... D04D 5/00 28/149

(Continued)

FOREIGN PATENT DOCUMENTS

DE 3518336 A1 * 11/1986 ..... D04B 3/06
DE 9213798 U1 * 12/1992 ..... A47B 41/02

(Continued)

OTHER PUBLICATIONS

"Sillbird Easel for Kids-Height Adjustable Standing Double Sided Chalkboard & Whiteboard and Magnetic Art Dry Erase Drawing Board with Art Supplies Accessories for Toddlers Boys Girls." Amazon, www.amazon.com/Sillbird-Kids-Height-Adjustable-Chalkboard-Accessories/dp/B0833WSL1M/ref=cm_cr_arp_d_product_ (Year: 2021) top?ie=UTF8. Accessed Apr. 28, 2021. (Year: 2021).*

(Continued)

*Primary Examiner* — Khoa D Huynh
*Assistant Examiner* — Grace Huang
(74) *Attorney, Agent, or Firm* — Cramer Patent & Design, PLLC; Aaron R. Cramer

(57) ABSTRACT

A crochet jig has a first planar frame secured within a second upright frame. The first frame is capable of full rotation along a horizontal axis. The top surface of the first frame is configured to retain a length of crocheted product on a first end and spooled yam on a second end.

17 Claims, 5 Drawing Sheets

(56) References Cited

U.S. PATENT DOCUMENTS

| | | | | | |
|---|---|---|---|---|---|
| 3,108,549 | A * | 10/1963 | Amsler, Jr. | A47B 91/02 | 108/6 |
| 3,211,113 | A * | 10/1965 | Randall | A47B 27/02 | 108/9 |
| 3,744,845 | A * | 7/1973 | Sooker | A47B 13/02 | 297/423.44 |
| 4,008,806 | A * | 2/1977 | de Paez | D05B 91/12 | 209/606 |
| 4,108,397 | A * | 8/1978 | Hauck | D04B 3/06 | 206/574 |
| 4,302,192 | A * | 11/1981 | Hamburger | D04B 3/00 | 116/240 |
| 4,372,631 | A * | 2/1983 | Leon | A47B 27/02 | 108/6 |
| 4,456,197 | A | 6/1984 | Canetta | | |
| 4,630,730 | A * | 12/1986 | Storey | D04B 3/06 | 206/388 |
| 4,955,557 | A | 9/1990 | Swell et al. | | |
| 5,005,380 | A * | 4/1991 | Downey | D04B 3/06 | 223/106 |
| 5,383,723 | A * | 1/1995 | Meyer | A47B 55/00 | 312/265.4 |
| 5,501,423 | A * | 3/1996 | Roberts | A47B 83/04 | 248/441.1 |
| 6,032,798 | A * | 3/2000 | Bryant | D04B 3/06 | 206/388 |
| 8,413,824 | B2 | 4/2013 | Cabassa | | |
| 9,580,269 | B2 * | 2/2017 | Quarandillo-Wold | D04B 33/00 | |
| 9,690,396 | B1 * | 6/2017 | Kubica | A47B 27/00 | |
| 10,595,632 | B2 * | 3/2020 | Elliott | F16B 12/16 | |
| 2007/0272635 | A1 * | 11/2007 | Cuadra, Jr. | D04B 3/06 | 211/78 |
| 2017/0208947 | A1 * | 7/2017 | Tsai | A47B 47/0083 | |
| 2019/0168375 | A1 * | 6/2019 | Castro | B25H 1/02 | |
| 2019/0290000 | A1 * | 9/2019 | Davis | A47B 57/34 | |
| 2021/0006046 | A1 * | 1/2021 | Thing | A47B 47/0083 | |

FOREIGN PATENT DOCUMENTS

| | | | | | |
|---|---|---|---|---|---|
| DE | 19944129 | A1 * | 3/2001 | A47B 13/08 | |
| FR | 1514467 | A * | 2/1968 | A47B 27/02 | |
| FR | 2178411 | A5 * | 11/1973 | D04B 3/00 | |
| GB | 603414 | A * | 6/1948 | A47B 27/02 | |
| GB | 731358 | A * | 6/1955 | D04B 3/00 | |
| GB | 2184461 | A * | 6/1987 | D04B 3/00 | |

OTHER PUBLICATIONS

"Premier White Board 48×36 Inch Mobile Whiteboard—Unboxing & Review." YouTube, YouTube, Feb. 28, 2019, www.youtube.com/watch?v=RiCuWn_pQrQ. (Year: 2019).*

"Types of Yarn Packaging." Dummies, Nov. 5, 2016, www.dummies.com/crafts/knitting/knitting-yarn/types-of-yarn-packaging/. (Year: 2016).*

Kate, et al. "Yarn Ball Types." Crochetpedia, Apr. 4, 2020, crochetpedia.com/yarn-ball-types/. (Year: 2020).*

White, Sarah E. "What is the Difference Between a Hank, a Ball, and a Skein of Yarn." The Spruce Crafts, Oct. 20, 2019, www.thesprucecrafts.com/what-is-a-hank-a-ball-a-skein-2117241. (Year: 2019).*

Kamelleo. "Mobile Whiteboard—48×36 Large Height Adjust 360° Rolling Double Sided Dry Erase Board, Magnetic White Board on Wheels, Office Classroom Portable Easel with Stand, Flip Chart Holders and Pad | White." Amazon, Jan. 4, 2019, www.amazon.com/Double-Sided-Mobile-Whiteboard-Magnetic/dp/B07MBQ7LNS (Year: 2019). (Year: 2019).*

Crone-Findlay, Noreen. "Bias Weaving on the Potholder Loom." YouTube, YouTube, May 14, 2010, www.youtube.com/watch?v=vbJTOMpFFg8. (Year: 2010).*

30 Spool STAND Sewing Notions Machine Thread & Bobbin Organizer Holder. Product Listing [online]. Copyright © 1995-2019 eBay Inc. [retrieved on Jun. 10, 2019]. Retrieved from the Internet: <URL: https://www.ebay.com/i/380795345660?chn=ps>.

DIY Ideas and Projects of Household Yarn Holders. Product Listing [online]. Pinterest.com [retrieved on Jun. 10, 2019]. Retrieved from the Internet: <URL: https://www.pinterest.com/pin/318418636134356292/>.

Yarn over. Product Listing [online]. Pinterest.com [retrieved on Jun. 10, 2019], Retrieved from the Internet: <URL: https://www.pinterest.com/pin/127930445647985055/?lp=true>.

* cited by examiner

CROCHET JIG

RELATED APPLICATIONS

Not applicable.

FIELD OF THE INVENTION

The present invention relates generally to the field of crocheting and more specifically to a crocheting jig.

BACKGROUND OF THE INVENTION

The hobbies of knitting and crocheting have remained popular throughout time. Not only do many people find these hobbies relaxing and enjoyable, but the resulting products or crafts are beautiful, valuable and functional. One project that many undertake is the making of large crocheted blankets. These colorful blankets are not only beautiful to look at but keep one very warm during cold days and nights.

However, one aspect associated with their construction, especially on ones with many colors, is the requirement to have many balls or skeins of yarn active at one time. Additionally, there is a need to flip the blanket over as it is being crocheted to not only keep colors and patterns aligned, but to keep letters and numbers from being reversed as well. Unfortunately, the requirement of many active yarn segments and the requirement to flip it back and forth usually always ends up with the entire project being one knotted mess. This not only adds unnecessary hours to a project, but simply takes the creative enjoyment out of it as well.

Accordingly, there exists a need for a means by which large crochet projects using many active segments of yarn can be easily flipped back and forth without the problems as described above. The development of the crochet jig fulfills this need.

SUMMARY OF THE INVENTION

The principles of the present invention provide for a rotating crochet aid which comprises four base members arranged in a rectangular configuration with four corresponding vertical members which extend upward from each of an intersecting corner of the base members and a pair of horizontal members each of which are connected to a pair of the four vertical members on each side of the rotating crochet aid. The rotating crochet aid also comprises a rotating frame which is mounted in between the pair of horizontal members via a pair of pivot mechanisms to rotate the rotating crochet aid. The rotating frame also has a pair of parallel working surfaces joined together by a pair of parallel separating members, a plurality of cross members, and a plurality of tubular members. The tubular members are bracketed between the cross members such that there is one of the tubular members for each of the cross members. The rotating crochet aid also comprises a stand which is attached to an upper surface of each the horizontal members to support one or more documents.

The cross members and the tubular members may each be attached at each of their distal ends to the pair of parallel working surfaces. The pair of the working surfaces may be utilized as a supply area. The pair of pivot mechanisms may allow the rotating frame to rotate in between the pair of horizontal members along a rotational path. The pair of pivot mechanisms may allow for up to three-hundred-sixty degrees of rotation. The rotating frame may be in a parallel position to the pair of horizontal members. The rotating frame may be rotated along the rotational path in either direction. The tubular members may be made of transparent hollow material with a pair of eyes located on an upper facing surface adjacent a distal end of each of the tubular members.

The tubular members may be made of translucent hollow material with the pair of eyes located on the upper facing surface adjacent the distal end of each of the tubular members. The rotating crochet aid may further comprise a plurality of yam balls that supply a plurality of yarn fibers disposed along the length of each of the cross members without tangling. The yarn balls may supply a plurality of skeins that supply the yarn fibers which are disposed along the length of each of the cross members without tangling. The rotating frame may allow for rotation of a crochet work in progress while simultaneously rotating the yarn balls which ensures that the yam fibers do not cross or otherwise become tangled. Each yarn ball may be held in place with a retaining means selected from the group consisting of a scrap of yam fiber, an elastic strap, or an adjustable strap with a hook-and-loop-fastener.

The yarn fibers from the yam balls may be routed through a first eye of the pair of eyes traversing through the tubular member and out through a second eye of the pair of eyes and may be utilized in the crochet work in progress. The stand may resemble a clipboard. The rotating crochet aid may have a rectangular parallelepiped shape. The rotating crochet aid may be made of material selected from the group consisting of dimensional lumber, plywood, press wood, particle board, polyvinyl chloride, or plastic. The rotating crochet aid may be floor standing. The base members may be in contact with a finished floor surface. The rotating crochet aid may be utilized in a seated position.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
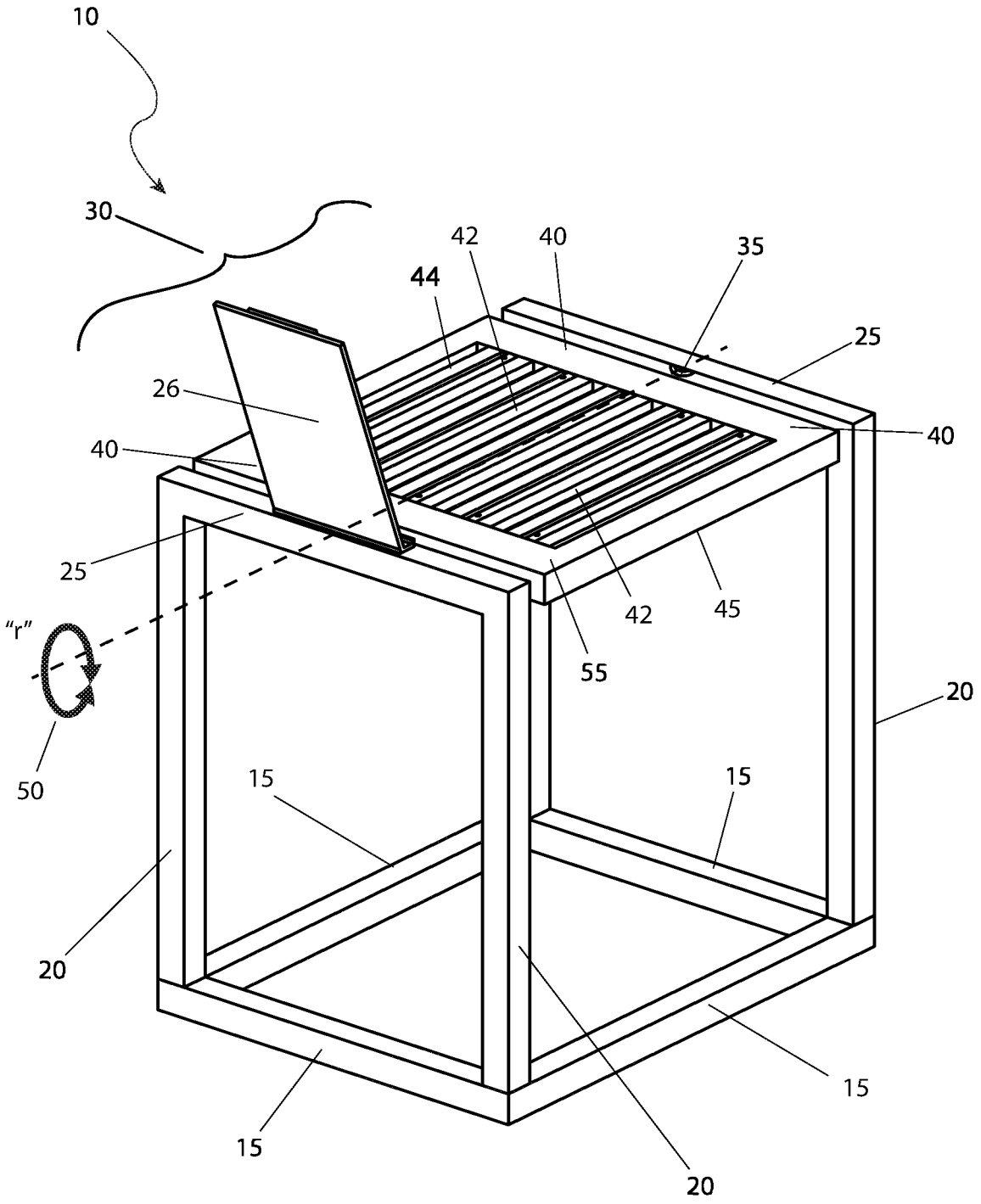
FIG. 1 is a perspective view of the rotating crochet aid 10, according to the preferred embodiment of the present invention.

10 rotating crochet aid
15 base member
20 vertical member
25 horizontal member
26 stand
30 rotating frame
35 pivot mechanism
40 working surface

42 cross member
44 tubular member
45 separating member
46 eye
50 rotational path "r"
55 supply area
60 yarn ball
65 yarn fiber
70 retaining means
75 crochet work in progress
76 hook and loop fastener

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the rotating crochet aid 10, according to the preferred embodiment of the present invention is disclosed. The rotating crochet aid 10 (herein also described as the "device") 10, takes the overall shape of a rectangular parallelepiped. The exact dimensions of the rotating crochet aid 10 may vary based upon the specific needs of the crocheted item being constructed. One (1) size may be approximately three feet (3 ft.) on all sides as depicted in FIG. 1. However, it may vary up to six feet (6 ft.) wide, or larger, with a corresponding increase in height, to allow for crocheting of larger items such as blankets. As such, the specific size (dimensions) of the device 10 are not intended to be a limiting factor of the present invention. The device 10 includes four (4) base members 15 arranged in a rectangular configuration along with four (4) vertical members 20 extending upward from each of the four (4) intersecting corners of the base members 15. Two (2) horizontal members 25 then each connect two (2) of the vertical members 20 on opposing (parallel) sides as shown.

A rotating frame 30 is mounted in between the two (2) horizontal members 25 via use of two (2) pivot mechanism 35. The rotating frame 30 has two (2) parallel working surfaces 40 joined together by two (2) parallel separating members 45, a plurality of cross members 42, and a plurality of tubular members 44. The cross members 42 and tubular members 44 are each attached at distal ends to the working surfaces 40. An individual tubular member 44 is bracketed between a pair of cross members 42 such that there is one (1) tubular member 44 for each pair of cross members 42. In an exemplary embodiment, there are ten (1) cross members 42 and five (5) tubular members 44. There may or may not be a gap between adjacent cross members 42 and between an adjacent cross member 42 and a separating member 45. The pivot mechanisms 35 allow the rotating frame 30 to rotate in between the two (2) horizontal members 25 along a rotational path "r" 50. Further description of the pivot mechanisms 35 will be provided herein below.

It is envisioned that the various members of the device 10 as aforementioned described could be made of a wide variety of materials, including but not limited to dimensional lumber, plywood, press wood, particle board, polyvinyl chloride (PVC), plastic, or the like. Additionally, the cross dimensional shape of the various members as aforementioned described could comprise a wide variety of shapes including but not limited to square, rectangular, circular, oval, or the like. As such, the material of construction of the device 10, as well as the cross dimensional shape of the base members 15, the vertical members 20, the horizontal members 25, the working surfaces 40, the separating members 45, the cross members 42, and the tubular members 44, are not intended to be a limiting factor of the present invention. The device 10 is intended for utilization by a user who is in an adjacent seated position.

Figure 2:
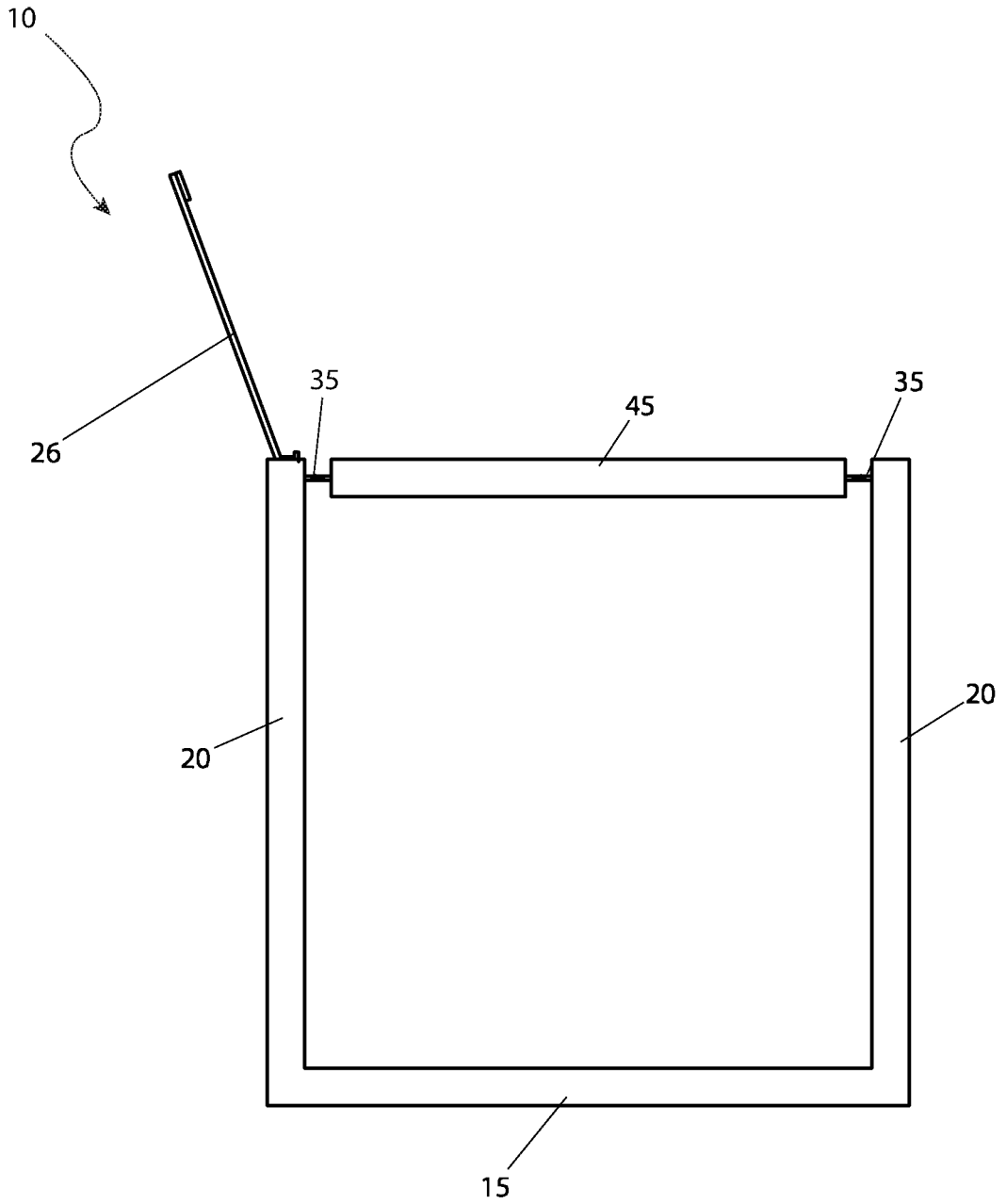
FIG. 2 is a side view of the rotating crochet aid 10, according to the preferred embodiment of the present invention.

Referring next to FIG. 2, a side view of the device 10, according to the preferred embodiment of the present invention is depicted. This view provides additional clarification on the assembly and configuration of the base members 15, the vertical members 20, the separating members 45 and the pivot mechanisms 35. It is noted that the device 10 is intended to be floor standing, with the base members 15 in contact preferable with a finish floor surface.

Figure 3:
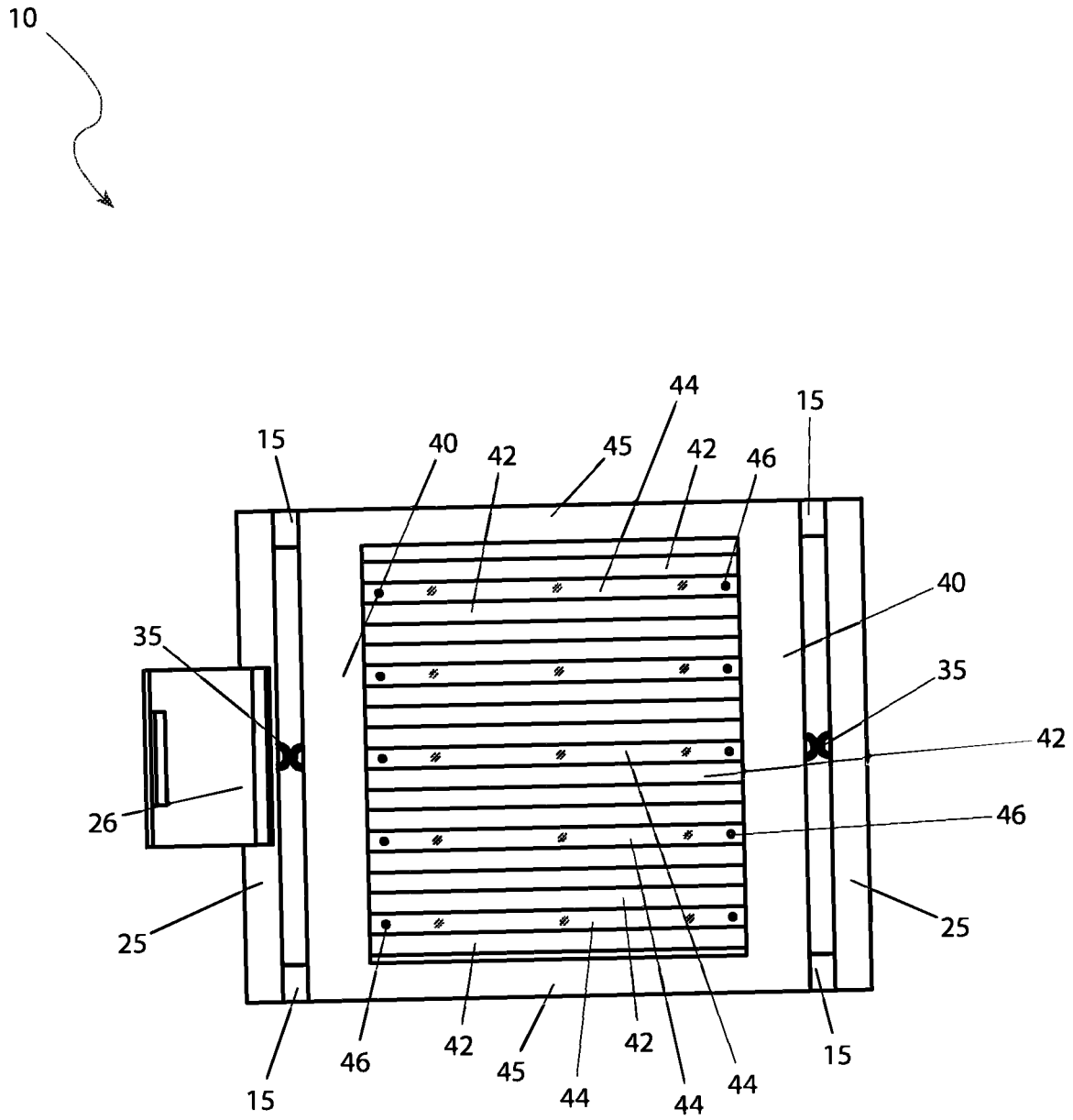
FIG. 3 is a top view of the rotating crochet aid 10, according to the preferred embodiment of the present invention.

Referring now to FIG. 3, a top view of the device 10, according to the preferred embodiment of the present invention is shown. This view provides additional clarification on the assembly and configuration of the horizontal members 25, the working surfaces 40, the separating members 45, and the pivot mechanisms 35. It is noted that the pivot mechanisms 35 allows up to three-hundred-sixty degrees (360°) of rotation.

Figure 4:
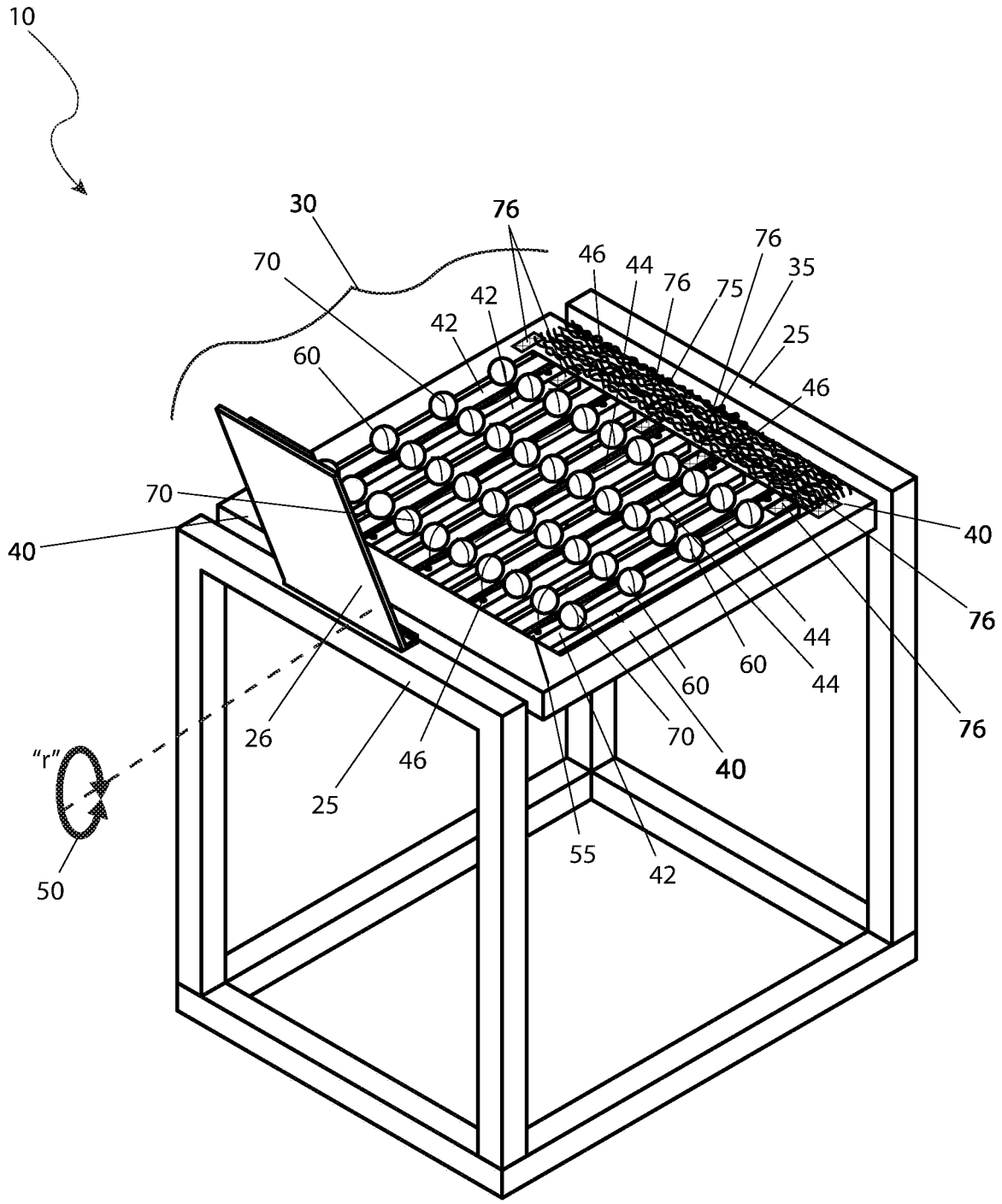
FIG. 4 is a perspective view of the rotating crochet aid 10, shown in a state of being utilized, according to the preferred embodiment of the present invention; and, FIG. 5 is a perspective view of the rotating crochet aid 10, shown in a state of partial rotation, according to the preferred embodiment of the present invention.

Referring next to FIG. 4, a perspective view of the device 10, shown in a state of being utilized, according to the preferred embodiment of the present invention is disclosed. The rotating frame 30 is in a parallel position to the horizontal members 25. One (1) of the two (2) sides (i.e., one (1) of the two (2) working surfaces 40) is utilized as a supply area 55. Along the length of each of the cross members 42, multiple yarn balls 60 or skeins that preferably supply respective yarn fibers 65 without tangling are capable of being attached thereto. The quantity of yarn balls 60 may vary from the quantity in FIG. 4, dependent on the needs of the user. Additionally, the quantity of the yarn balls 60 will also be dependent on the overall size (width) of the working surfaces 40, with smaller working surfaces 40 used to make smaller objects such as scarves, while larger (wider) working surfaces 40 would be used to make larger objects such as blankets or shawls. Each yarn ball 60 is held in place with a retaining means 70 such as a scrap of yarn fiber, an elastic strap, an adjustable strap with a hook and loop fastener (Velcro) 76, or the like. The exact nature of the retaining means 70 is not intended to be a limiting factor of the present invention.

The tubular members 44 are preferably a transparent or translucent hollow material with a pair of eyes 46 located on an upper facing surface adjacent the distal ends thereof. Yarn fibers 65 from the yarn ball 60 is routed through a first eye (not shown) located adjacent the supply area 55, traversing through the tubular member 44 and out through the other eye (not shown). The various yarn fibers 65 are then utilized in a crochet work in progress 75. Standard, well-known crocheting methods are utilized, and are not within the scope of the present invention. It is envisioned that the user would be in a seated position adjacent to the crochet work in progress 75 during the crocheting process.

A stand 26 is attached to an upper surface of the horizontal member 25 located within the supply area 55. The stand 26 may or may not be fixedly or removably attached thereto and may further resemble a clipboard. The stand 26 is capable of supporting documents that aid in the preparation (e.g., patterns) of the desired finished crochet work in progress 75.

Figure 5:
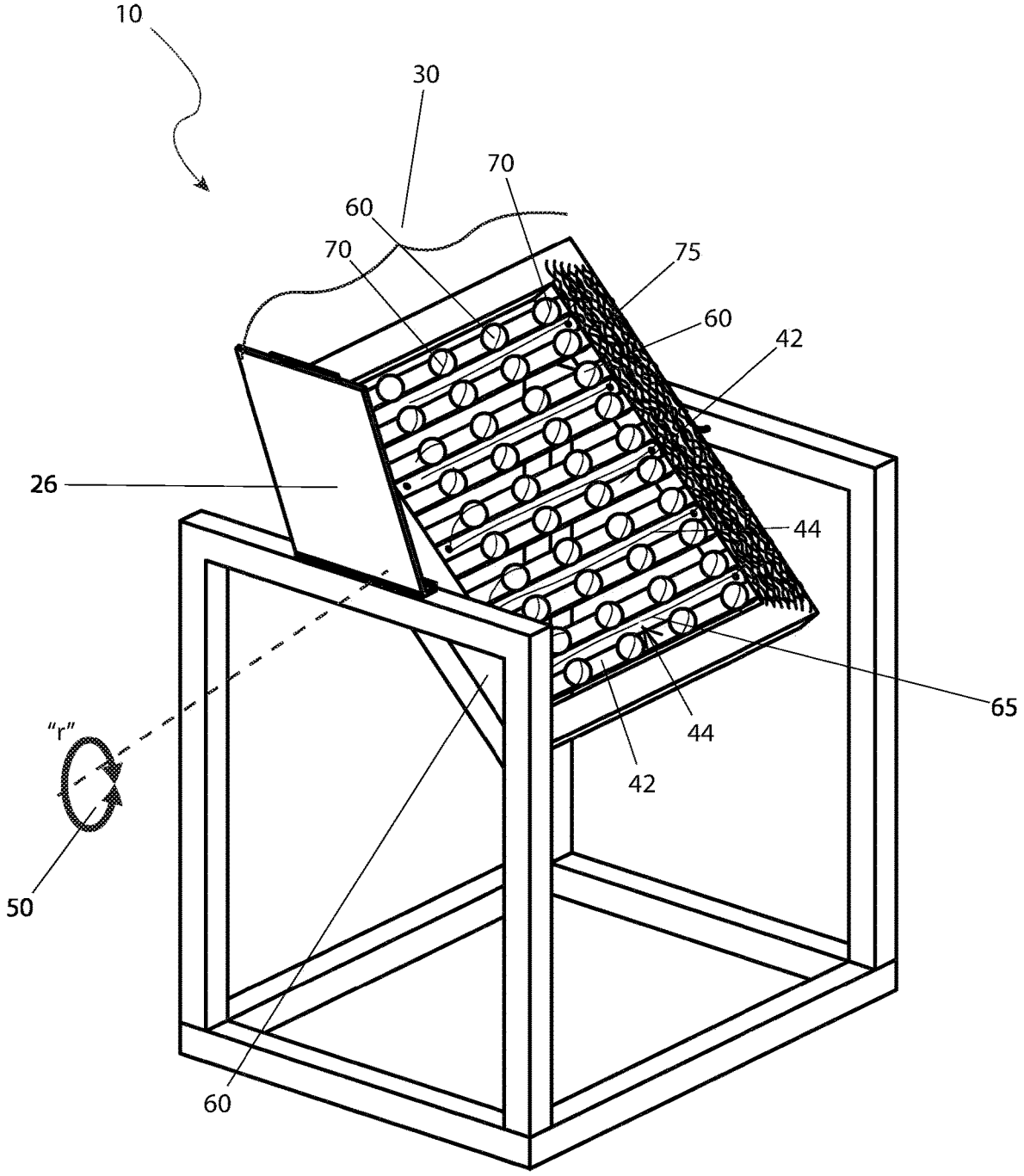

Referring to FIG. 5, a perspective view of the device 10, shown in a state of partial rotation, according to the preferred embodiment of the present invention is depicted. As the crocheting process proceeds as described in FIG. 4, it is necessary to flip the crochet work in progress 75 as crocheting proceeds along the length of the crochet work in progress 75 as it reverses in direction and proceeds once again down the crochet work in progress 75, but in the opposite direction. The rotating nature of the rotating frame 30, allows the rotation of the crochet work in progress 75 to take place, while at the same time rotating the yarn balls 60 in the same manner, thus ensuring that the yarn fibers 65 do not cross or otherwise become tangled. Whereupon it is necessary to rotate the rotating frame 30 one hundred-eighty degrees (180), the user rotates along the rotational path "r" 50 (in either direction) and pulls the crochet work in progress 75 through the center opening (not shown). The crocheting process can then continue without worry of tangling of the yarn fibers 65. This rotation process whenever direction of crocheting is reversed continues until the crocheting process and the crochet work in progress 75 is complete.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as arts and crafts stores, discount department stores, main order and internet supply houses or the like. Special attention would be paid to the overall materials of construction as well as the overall size (width) of the working surfaces 40 to ensure that it will be adequate in size for the crochet project being considered.

After procurement and prior to utilization, the device 10 would be prepared in the following manner: the device 10 would be set up as indicated in FIG. 1; various yarn balls 60 as needed in color and quantity would be affixed to the cross members 42 as indicated in FIG. 4; said yarn balls 60 would be secured in place via respective retaining means 70; yarn fibers 65 from each of the yarn balls 60 would be routed through the tubular members 44 via the eyes 46, where they would be engaged in a crochet work in progress 75 using well-known and various crocheting methods.

During utilization of the device 10, the following procedure would be initiated: said crocheting process would continue along the entire length of the crochet work in progress 75; when it is necessary to reverse direction of the crocheting process and proceed back along the crochet work in progress 75, the user would rotate the rotating frame 30 along the rotational path "r" 50 while pulling the crochet work in progress 75 onto the working surfaces 40; the crocheting process then continues in an uninterrupted manner until the rotating frame 30 must be rotated again. This process of crocheting, rotating, crocheting, rotating, etc. continues until the crochet work in progress 75 is completed.

After use of the device 10, any remaining yarn balls 60 and yam fibers 65 are removed, and the device 10 is stored away until needed again where the above-mentioned process would be repeated in a continuous, repeating cycle.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A rotating crochet aid, comprising:

four base members arranged in a rectangular configuration with four corresponding vertical members extending upward from each of an intersecting corner of the base members and a pair of horizontal members each connected to a pair of the four vertical members on each side of the rotating crochet aid; and a rotating frame mounted in between the pair of horizontal members via a pair of pivot mechanisms to rotate the rotating crochet aid, the rotating frame has a pair of parallel working surfaces joined together by a pair of parallel separating members, a plurality of cross members, and a plurality of tubular members;

wherein the tubular members are made of transparent hollow material or translucent hollow material with a pair of eyes located on an upper facing surface adjacent a distal end of each of the tubular members.

2. The rotating crochet aid according to claim 1, wherein the cross members and the tubular members are each attached at each of their distal ends to the pair of parallel working surfaces.

3. The rotating crochet aid according to claim 1, wherein one of the pair of the working surfaces is utilized as a supply area.

4. The rotating crochet aid according to claim 1, wherein the pair of pivot mechanisms allow the rotating frame to rotate in between the pair of horizontal members along a rotational path.

5. The rotating crochet aid according to claim 4, wherein the pair of pivot mechanisms allow up to three-hundred-sixty degrees of rotation.

6. The rotating crochet aid according to claim 4, wherein the rotating frame is in a parallel position to the pair of horizontal members.

7. The rotating crochet aid according to claim 4, wherein the rotating frame is rotatable along the rotational path in either direction.

8. The rotating crochet aid according to claim 1, further comprising a plurality of yarn balls that supply a plurality of yarn fibers disposed along the length of each of the cross members without tangling.

9. The rotating crochet aid according to claim 8, wherein the yarn balls supply a plurality of skeins that supply the yarn fibers disposed along the length of each of the cross members without tangling.

10. The rotating crochet aid according to claim 8, wherein the rotating frame allows rotation of a crochet work in progress while simultaneously rotating the yarn balls ensuring that the yarn fibers do not cross or otherwise become tangled.

11. The rotating crochet aid according to claim 10, wherein each of the yarn balls are held in place with a retaining means selected from the group consisting of a scrap of yarn fiber, an elastic strap, or an adjustable strap with a hook-and-loop-fastener.

12. The rotating crochet aid according to claim 1, wherein the stand resembles a clipboard.

13. The rotating crochet aid according to claim 1, wherein the rotating crochet aid has a rectangular parallelepiped shape.

14. The rotating crochet aid according to claim 1, wherein the rotating crochet aid is made of material selected from the group consisting of dimensional lumber, plywood, press wood, particle board, polyvinyl chloride, or plastic.

15. The rotating crochet aid according to claim 1, wherein the rotating crochet aid is configured to be floor standing.

16. The rotating crochet aid according to claim 1, wherein the base members are configured to be in contact with a finished floor surface.

17. The rotating crochet aid according to claim 1, wherein the rotating crochet aid is configured to be utilized in a seated position.

* * * * *